US005829944A

United States Patent [19]

Szinte

[11] Patent Number: 5,829,944

[45] Date of Patent: Nov. 3, 1998

[54] MULTI-SIDE REFUSE RECEPTACLE COLLECTION ASSEMBLY

[75] Inventor: Zoltan Szinte, Des Plaines, Ill.

[73] Assignee: Kann Manufacturing Corporation, Iowa

[21] Appl. No.: 703,132

[22] Filed: Aug. 26, 1996

Related U.S. Application Data

[63] Continuation-in-part of Ser. No. 666,927, Jun. 20, 1996.

[51] Int. Cl.[6] ..... B65F 3/04

[52] U.S. Cl. ..... 414/420; 414/406; 414/408; 414/555

[58] Field of Search ..... 414/406, 408, 414/420, 549, 550, 552, 553, 555, 664, 667

[56] References Cited

U.S. PATENT DOCUMENTS

| | | | |
|---|---|---|---|
| 2,906,419 | 9/1959 | Visco et al. . | |
| 3,016,157 | 1/1962 | Brisson . | |
| 3,083,849 | 4/1963 | Mottin . | |
| 3,136,436 | 6/1964 | Erlinder et al. . | |
| 3,148,793 | 9/1964 | Walter . | |
| 3,446,377 | 5/1969 | Heinert . | |
| 3,576,265 | 4/1971 | Brady et al. . | |
| 3,762,586 | 10/1973 | Updike, Jr. . | |
| 3,765,554 | 10/1973 | Morrison . | |
| 3,822,802 | 7/1974 | Evans, Jr. . | |
| 3,825,133 | 7/1974 | Owen, Jr. . | |
| 3,921,839 | 11/1975 | Herpich . | |
| 3,944,092 | 3/1976 | Ebeling et al. . | |
| 4,042,137 | 8/1977 | Hughes et al. . | |
| 4,057,154 | 11/1977 | Neufeldt . | |
| 4,057,157 | 11/1977 | Park et al. . | |
| 4,096,959 | 6/1978 | Schäffler | 414/408 |
| 4,175,903 | 11/1979 | Carson | 414/408 |
| 4,278,390 | 7/1981 | Ahearn . | |
| 4,363,588 | 12/1982 | Stickney . | |
| 4,401,407 | 8/1983 | Breckenridge . | |
| 4,461,608 | 7/1984 | Boda . | |
| 4,543,028 | 9/1985 | Bell et al. . | |
| 4,636,131 | 1/1987 | Sinclair | 414/667 X |
| 4,708,570 | 11/1987 | Smith et al. . | |
| 4,722,658 | 2/1988 | Würtz et al. . | |
| 4,726,726 | 2/1988 | Dossena et al. . | |
| 4,854,406 | 8/1989 | Appleton et al. . | |
| 4,921,389 | 5/1990 | O'Daniel . | |
| 4,936,732 | 6/1990 | Naab et al. . | |
| 4,983,092 | 1/1991 | Richards . | |
| 4,986,074 | 1/1991 | Hahmann et al. | 60/468 |
| 5,015,142 | 5/1991 | Carson | 414/408 |
| 5,035,563 | 7/1991 | Mezey | 414/409 |
| 5,036,952 | 8/1991 | Harper | 414/667 X |
| 5,064,332 | 11/1991 | Edelhoff et al. . | |
| 5,069,593 | 12/1991 | Zelinka et al. . | |
| 5,071,303 | 12/1991 | Carson | 414/21 |
| 5,122,025 | 6/1992 | Glomski | 414/486 |

(List continued on next page.)

FOREIGN PATENT DOCUMENTS

| | | | |
|---|---|---|---|
| 0 314 238 | 5/1989 | European Pat. Off. . | |
| 0 405 428 | 2/1991 | European Pat. Off. . | |
| 15 31 763 | 1/1970 | Germany . | |
| 2453721 | 5/1976 | Germany | 414/667 |
| 35 37 546 | 4/1987 | Germany . | |
| 8001741 | 10/1981 | Netherlands . | |
| 0971732 | 11/1982 | U.S.S.R. | 414/408 |
| 2234487 | 2/1991 | United Kingdom | 414/667 |
| WO 93/15982 | 8/1993 | WIPO . | |

*Primary Examiner*—James W. Keenan
*Attorney, Agent, or Firm*—Foley & Lardner

[57] ABSTRACT

A refuse receptacle collection assembly includes a receptacle engaging assembly and a pivot assembly. The receptacle engaging assembly is configured for engaging a refuse receptacle to move the refuse receptacle. The pivot assembly pivots the receptacle engaging assembly between a first position in which the engaging assembly faces streetside for engaging receptacles located streetside and a second position in which the engaging assembly faces curbside for engaging receptacles located curbside.

18 Claims, 10 Drawing Sheets

U.S. PATENT DOCUMENTS 5,163,805 11/1992 Mezey ..... 414/786
5,176,488 1/1993 Boda ..... 414/525.4
5,190,433 3/1993 Boda ..... 414/525.1
5,192,031 3/1993 Gilbert ..... 241/101.7
5,205,698 4/1993 Mezey ..... 414/406
5,209,537 5/1993 Smith et al. .
5,222,853 6/1993 Carson ..... 414/408
5,266,000 11/1993 LeBlanc, Jr. .
5,288,196 2/1994 Horning et al. ..... 414/407
5,303,841 4/1994 Mezey ..... 220/555
5,308,211 5/1994 Bayne .
5,333,984 8/1994 Bayne et al. .
5,335,958 8/1994 Christenson et al. ..... 296/56
5,344,273 9/1994 Radlein ..... 414/409
5,368,436 11/1994 Freiburger ..... 414/786
5,375,960 12/1994 Schiller .
5,391,039 2/1995 Holtom .
5,419,671 5/1995 Smith et al. .
5,470,187 11/1995 Smith et al. .
5,482,180 1/1996 Smith et al. .
5,484,245 1/1996 Zopf ..... 414/408

Fig. 8A
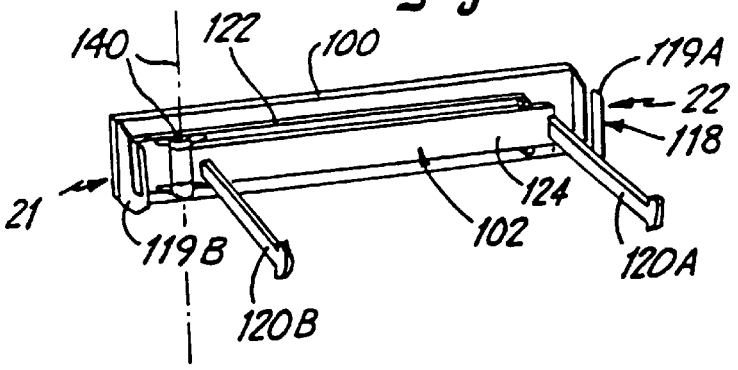
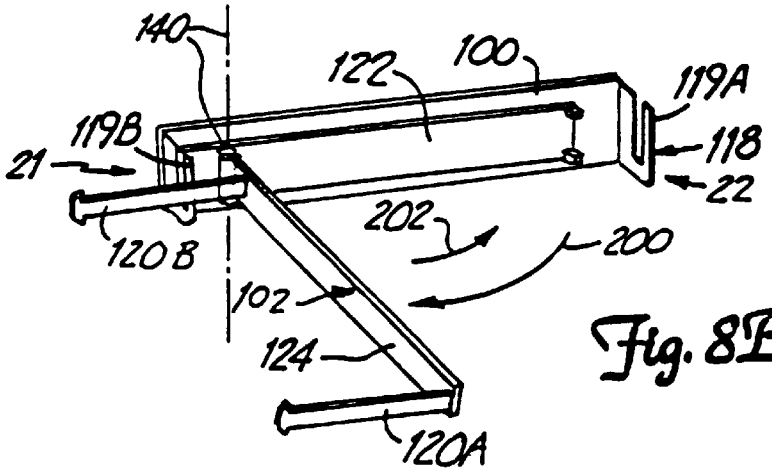
Fig. 8B
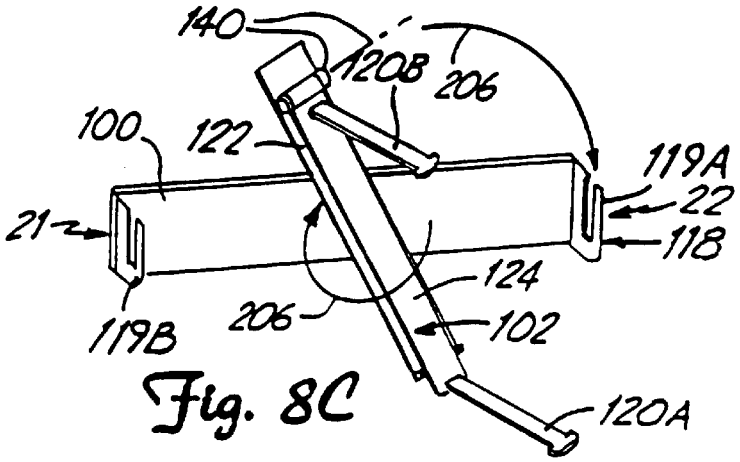
Fig. 8C

MULTI-SIDE REFUSE RECEPTACLE COLLECTION ASSEMBLY

This is a continuation-in-part of U.S. patent application Ser. No. 08/666,927 filed on Jun. 20, 1996 and entitled "REFUSE RECEPTACLE COLLECTION ASSEMBLY."

BACKGROUND OF THE INVENTION

The present invention relates to refuse collection vehicles for hauling waste and recyclable commodities. In particular, the present invention relates to a refuse receptacle collection assembly configured for being supported between a curbside and a streetside of a refuse collection vehicle, wherein the refuse receptacle collection assembly includes a refuse engaging assembly and means coupled to the refuse receptacle engaging assembly for selectively repositioning the engaging assembly so that the engaging assembly may be moved between a first position in which the engagement assembly faces streetside for engaging refuse receptacles located streetside and a second position in which the engaging assembly faces curbside for engaging refuse receptacles located curbside.

Refuse, including both recyclable commodities and non-recyclable commodities, is typically stored and contained in a variety of receptacles including dumpsters, carts and cans prior to pick-up by a refuse collection vehicle. Typically, the refuse receptacles are placed adjacent a street, either curbside (the right side of the street) or streetside (the left side of the street) for pick-up by a refuse collection vehicle.

Refuse collection vehicles typically comprise an elongate vehicle having a storage body and a pair of arms extending in front of the refuse collection vehicle. The arms support receptacle engaging members such as spaced apart forks, claws or grabber arms which face forward the storage body and which engage and hold the refuse receptacle while the arms lift and tip the receptacle to unload the refuse into the collection vehicle.

To engage the receptacle, the engaging members must be aligned and moved into engagement with the refuse receptacle. Usually, the vehicle is driven forward with sideways adjustments to align and engage the engaging members with the refuse receptacle. However, in narrow streets or confined loading areas, aligning the engaging members with a receptacle positioned streetside or curbside is difficult and time consuming, if not impossible.

In an attempt to solve this problem, some refuse collection vehicles have been provided with side mounted engaging members that face one side of the vehicle or side pivoting engaging members that pivot from the front of the vehicle to one side of the vehicle. Although side mounted engaging members or side pivoting engaging members are generally easier to align with refuse receptacles, side mounted and side pivoting engaging members can typically only engage receptacles positioned on one side of a street, either curbside or streetside. As a result, the refuse collection vehicle must be driven in opposite directions down the same street to collect refuse receptacles positioned on both sides of the street.

This collection process has several inherent problems. First, receptacles positioned on both sides of a one-way street cannot be easily collected. Second, turning the refuse collection vehicle around is time consuming and extremely difficult in narrow streets and confined areas. Most importantly, driving the refuse collection vehicle in two directions on every street to collect and empty receptacles positioned on both sides of the street requires that the vehicle make two passes on each street of the collection route, thereby requiring more time, expense and fuel consumption.

SUMMARY OF THE INVENTION

The present invention is a refuse receptacle collection assembly capable of collecting refuse receptacles positioned on a curbside and a streetside of a refuse collection vehicle. The refuse receptacle collection assembly includes a receptacle engaging assembly configured for engaging a refuse receptacle to move the receptacle and means coupled to the receptacle engaging assembly for selectively repositioning the engaging assembly so that the engaging assembly may be moved between a first position in which the engaging assembly faces streetside for engaging receptacles located streetside and a second position in which the engaging assembly faces curbside for engaging receptacles located curbside. In one preferred embodiment of the present invention, the means rotates the receptacle engaging assembly approximately 180 degrees in a generally vertical plane to move the receptacle engaging assembly between the first and second positions.

BRIEF DESCRIPTION OF THE DRAWINGS

FIGS. 8A–8E are perspective views illustrating the pivot arm assembly and the receptacle engaging assembly rotated and pivoted relative to the carriage assembly for engaging refuse receptacles positioned curbside, streetside and in front of the refuse collection vehicle.

DETAILED DESCRIPTION OF THE PREFERRED EMBODIMENTS

Throughout the specification of the application, various terms are used such as "top", "bottom", "front", "rear", "forward", "rearward" and the like. These terms denote directions with respect to the drawings and are not limitations of orientation of the present invention. Rather, these terms are provided for clarity in describing the relationship between members of the refuse collection vehicle.

I. OVERVIEW

Figure 1:
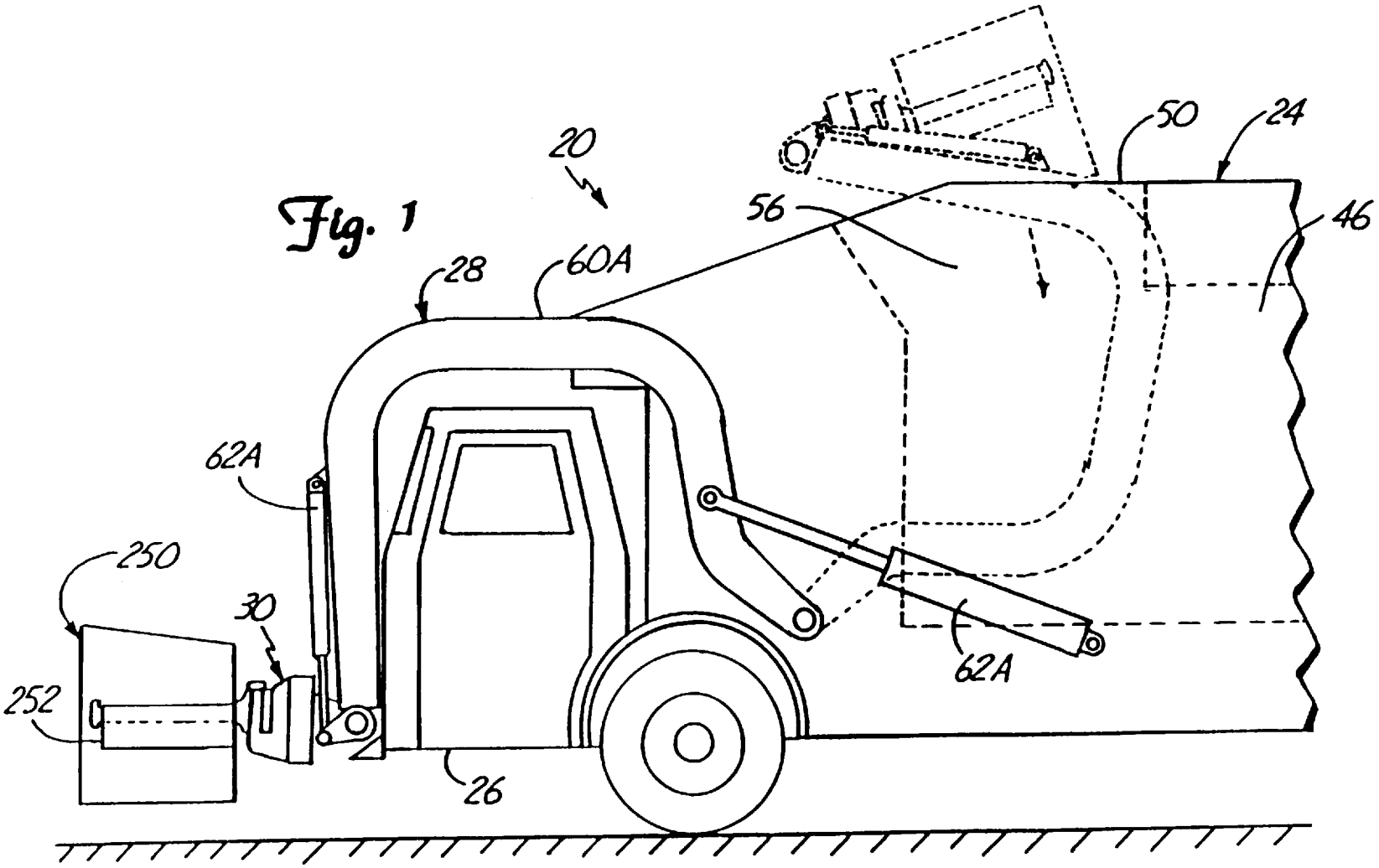
FIG. 1 is a side elevational view of a front portion of a refuse collection vehicle of the present invention.

FIG. 1 is a side elevational view of a front portion of refuse collection vehicle 20 for collecting refuse contained in a refuse receptacle 250 having fork receiving channels 252. Fork receiving channels 252 extend along the sides of refuse receptacle 250 and are sized for receiving receptacle engaging members of refuse collection vehicle 20. Refuse receptacle 250 is supported forward of refuse collection vehicle 20 between a curbside 21 and a streetside 22 (shown in FIG. 2). Refuse collection vehicle 20 generally includes storage body 24, cab 26, dumping assembly 28 and automated refuse receptacle collection assembly 30.

Storage body 24 is supported rearward of cab 32 and includes storage portion 46 and loading portion 50. Storage portion 46 extends between loading portion 50 and a tailgate assembly (not shown). Storage portion 46 holds refuse and commodity during transportation from a collection site to a disposal or recycling site.

Loading portion 50 of storage body 24 is preferably positioned forward of storage portion 46 and includes loading chute 56 and a compactor assembly (not shown). Loading chute 56 comprises an elongate generally vertical refuse passageway extending from the top of storage body 24 towards frame 34. Chute 56 communicates with storage portion 46. As a result, refuse and commodity loaded into loading chute 56 flows into storage portion 46.

A compactor assembly (not shown), as conventionally known, is preferably located within loading chute 56 for moving refuse from loading chute 56 into storage portion 46 and for compacting the refuse and commodity within storage portion 46.

Receptacle dumping assembly 28 lifts and empties contents of an engaged refuse receptacle, such as receptacle 250, and generally includes a pair of lifting arms 60*a*, 60*b* (shown in FIG. 2) and corresponding power devices 62*a*, 62*b* (not shown). Arms 60*a*, 60*b* pivotally extend in front of cab 32 to engage and support receptacle engaging assembly 30 forward of cab 32. Arms 60*a*, 60*b* are lifted by power devices 62*a*, 62*b* (not shown). Power devices 62 preferably comprise hydraulic piston/cylinder assemblies which are hydraulically controlled by control means within cab 32 as is conventionally known in the art. Power devices 62 lift arms 60*a*, 60*b* and engaged refuse receptacle 250 upward and rearward of cab 32 to empty the contents of the refuse receptacle into storage body 24 as shown in phantom. Once receptacle 250 is unloaded into loading chute 56, arms 60*a* and 60*b* lower and tilt receptacle 250 for repositioning receptacle 250.

Refuse receptacle collection assembly 30 is supported by dumping assembly 28 and is configured for engaging a refuse receptacle located in front of vehicle 20 or on either curbside 21 or streetside 22. Upon engaging the refuse receptacle, refuse receptacle collection assembly 30 repositions the engaged refuse receptacle forward refuse collection vehicle 20 generally between lifting arms 60*a*, 60*b* of receptacle dumping assembly 28. After the refuse receptacle collection assembly repositions the refuse receptacle, dumping assembly 28 lifts engaged refuse receptacle upward and rearward of cab 32 to unload the refuse receptacle into storage body 24.

II. RECEPTACLE COLLECTION ASSEMBLY

Figure 2:
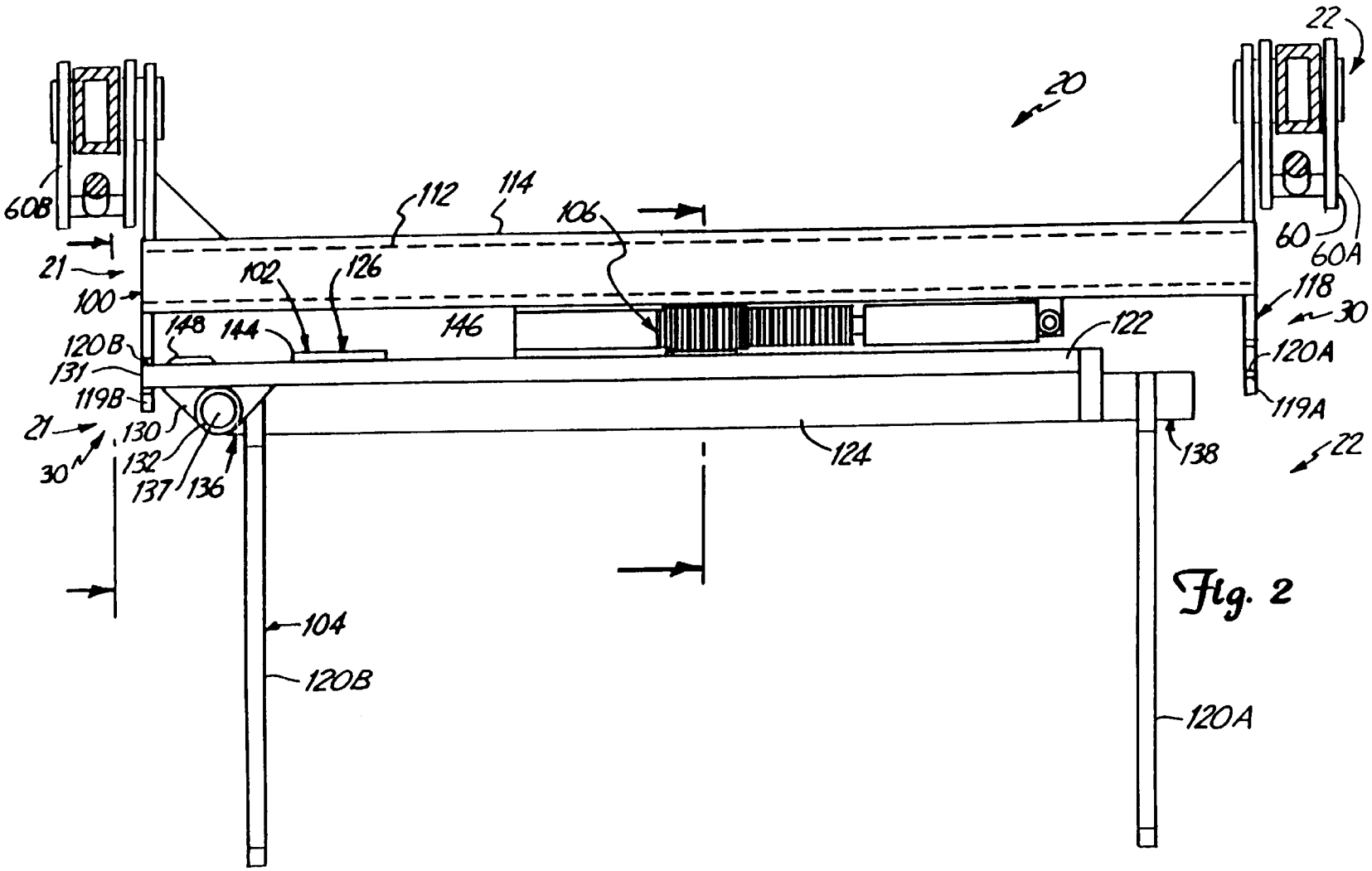
FIG. 2 is a top elevational view of a receptacle collection assembly of the refuse collection vehicle.

FIG. 2 is a top elevational view of refuse collection vehicle 20 illustrating receptacle collection assembly 30 in greater detail. As shown by FIG. 2, automated refuse receptacle collection assembly 30 generally includes carriage assembly 100, horizontal pivot arm assembly 102, receptacle engaging assembly 104 and vertical pivot assembly 106. Carriage assembly 100 generally includes track 112, carriage 114, linear actuator assembly 116 (shown in FIG. 3) and pivot arm assembly support 118. Track 112 is fixedly coupled to lifting arms 60*a*, 60*b* of dumping assembly 28 along a front end of cab 32. Track 112 preferably extends from streetside 22 to curbside 21 of vehicle 20. Track 112 preferably projects past arms 60*a*, 60*b* so that carriage 114 may also project further outward towards curbside 21 and streetside 22. Track 112 movably supports carriage 114 between arms 60*a*, 60*b* and guides movement of carriage 114 and receptacle engaging assembly 104 between curbside 21 and streetside 22.

Carriage 114 is movably coupled to track 112 as to move along track 112 between streetside 22 and curbside 21. Carriage 114 is bi-directionally movable along track 112 so that receptacle engaging assembly 104 may be movable proximate to both curbside 21 and streetside 22. Carriage 114 supports receptacle engaging assembly 104 between arms 60*a*, 60*b* and along track 112. Linear actuator assembly 116 (shown in FIG. 4) selectively moves carriage 114 along track 112 so as to selectively position pivot arm assembly 102 and receptacle engaging assembly 104 proximate to either curbside 21 or streetside 22.

Pivot arm assembly support 118 supports and stabilizes pivot arm assembly 102 in a general horizontal orientation during the collection of refuse receptacles located curbside 21 and streetside 22. Pivot arm assembly support 118 includes support flanges 119*a*, 119*b*. Support flanges 119*a*, 119*b* are coupled to opposite ends of carriage 114 and define slots 120*a*, 120*b*, respectively. Slots 120*a*, 120*b* open vertically upward and are sized for receiving portions of pivot arm assembly 102. Slot 120*a* partially receives pivot arm assembly 102 when pivot arm assembly 102 is oriented for engaging refuse receptacles located streetside 22. Slot 120*b* is positioned for receiving pivot arm assembly 102 when pivot arm assembly 102 is positioned for engaging a refuse receptacle located curbside 21. Either of slots 120*a*, 120*b* may be used for receiving pivot arm assembly 102 when pivot arm assembly 102 faces forward of refuse collection vehicle 20 depending upon the rotational position of pivot arm assembly 102. Because slots 120*a*, 120*b* at least partially receive pivot arm assembly 102, pivot arm assembly 102 and receptacle engaging assembly 104 are more stably and securely supported in a horizontal orientation when engaging a refuse receptacle.

Pivot arm assembly 102 is coupled to carriage 114 of carriage assembly 100 and includes base 122, pivot arm 124 and actuator 126. Base 122 is coupled to carriage 114 by pivot assembly 106. Pivot arm 124 is a generally elongate support having an end 136 pivotally coupled to end 131 of base 122 to permit opposite end 138 of pivot arm 124 to pivot in a horizontal plane so as to swing or pivot between a first position in which pivot arm 124 is generally parallel to base 122 and a second position in which pivot arm 124 is generally perpendicular to base 122. Because end 136 of pivot arm 124 is pivotally coupled to end 131 of base 122, pivot arm 124 may be pivotally extended closer to curbside 21 (as illustrated) or closer to streetside 22 (upon rotation of pivot arm assembly 102 by pivot assembly 106). Pivot arm 124 supports receptacle engaging assembly 104 and swings or pivots receptacle engaging assembly 104 with respect to base 122 between a forward facing position in which receptacle engaging assembly generally extends forward of cab 32 (shown in FIG. 1) and a side facing position in which receptacle engaging assembly extends towards either curbside 21 or streetside 22 to engage a refuse receptacle, depending upon a selected rotational position of pivot assembly 106. As a result, pivot arm assembly 102 pivots receptacle engaging assembly 104 so as to face towards one side of the refuse collection vehicle to engage a refuse collection vehicle located either streetside or curbside and further pivots the engaged refuse receptacle from the streetside or curbside to a location directly in front of the refuse collection vehicle between arms 60*a* and 60*b* so that the refuse receptacle may be lifted and unloaded over cab 32 into loading chute 56. In addition, pivot arm assembly 102 enables refuse engaging assembly 104 to face forward of the refuse collection vehicle or curbside or streetside, depending upon the selected rotational position of pivot assembly 106, to engage refuse receptacles positioned forward or to one side of the refuse collection vehicle. Although pivot arm 124 may be manually pivoted, pivot arm assembly 102 is preferably provided with an actuator 126. Actuator 126 is coupled between base 122 and pivot arm 124 to selectively pivot arm 124 in a horizontal plane with respect to base 122.

As can be appreciated, pivot arm assembly 102 may have a variety of alternative configurations. For example, in lieu of being coupled to base 122 which is coupled parallel to carriage 114, pivot arm 124 may alternatively be directly pivotally coupled to carriage 114. Furthermore, although pivot arm 124 is illustrated as an elongate, generally straight support, pivot arm 124 may alternatively comprise a rigid L or T-shaped support member which is pivotally coupled to base 122 or carriage 114 to face curbside 21 or streetside 22 depending upon the rotational position of pivot assembly 106.

Receptacle engaging assembly 104 is coupled to pivot arm assembly 102 and to carriage 114 forward cab 32. Receptacle engaging assembly 104 is configured for specifically engaging a particular type of refuse receptacle. In the embodiment illustrated, receptacle engaging assembly 104 preferably comprises a pair of fixed spaced support arms or forks 120*a*, 120*b* for engaging opposite sides of a refuse receptacle 250 (shown in FIG. 1). As can be appreciated, receptacle engaging assembly 104 may have a variety of configurations depending upon the particular type of refuse receptacle to be engaged. For example, in lieu of a pair of forks configured for engaging opposite sides of the refuse receptacle, receptacle engaging assembly 104 may alternatively include any one of a variety of grabbing mechanisms for engaging differently shaped surfaces of a refuse receptacle such as hooks, movable grabber arms or any one of a variety of other conventional receptacle grabbing or engaging structures.

Pivot assembly 106 is coupled between carriage 114 of carriage assembly 100 and base 122 of pivot arm assembly 102. Pivot assembly 106 rotatably supports pivot arm assembly 102 and receptacle engaging assembly 104 with respect to carriage 114 to enable pivot arm assembly 102 to pivot receptacle engaging assembly 104 to a first position in which engaging assembly 104 faces streetside for engaging receptacles located streetside and to a second position in which engaging assembly 104 faces curbside for engaging receptacles located curbside. Pivot assembly 106 preferably includes a rotary actuator 128 for providing selective, non-manual movement of receptacle engaging assembly 104 between the first and second positions. In the preferred embodiment illustrated, pivot assembly 106 pivots or rotates receptacle engaging assembly 104 in a generally vertical plane so as to face both curbside 21 and streetside 22. Alternatively, pivot assembly 106 may be configured for pivoting or rotating a receptacle engaging assembly in a generally horizontal plane forward of cab 32 to pivot receptacle engaging assembly 104 in a substantially 180 degree arc forward of cab 32 so as to selectively move receptacle engaging assembly 104 between the first position in which engagement assembly faces streetside 22 and the second position in which engagement assembly 104 faces curbside 21. In such an alternative arrangement, receptacle engaging assembly 104 and pivot assembly 106 enable receptacle engaging members such as forks 120*a* , 120*b*to face curbside 21, streetside 22 or directly forward of vehicle 20 for engaging a refuse receptacle in any of the three positions with respect to vehicle 20.

Once receptacle engaging assembly 104 is selectively positioned so as to face a receptacle located either curbside 21 or streetside 22, carriage assembly 100 may be selectively moved to move receptacle engaging assembly 104 towards either the curbside 21 or streetside 22 to engage the refuse receptacle. If the refuse receptacle is located forward of cab 32, vehicle 20 is merely driven forward to engage the refuse receptacle. Once receptacle engaging assembly 104 engages the refuse receptacle, pivot arm 124 is selectively pivoted so as to be generally parallel to base 122 and carriage 114. Pivoting of pivot arm 124 moves the engaged refuse receptacle between arms 60*a*, 60*b* (shown in FIGS. 1 and 2) and forward cab 32. Once the refuse receptacle is engaged and is positioned forward of cab 32, dumping assembly 28 lifts the engaged refuse receptacle so as to unload the refuse receptacle into storage body 24.

A. CARRIAGE ASSEMBLY

Figure 3:
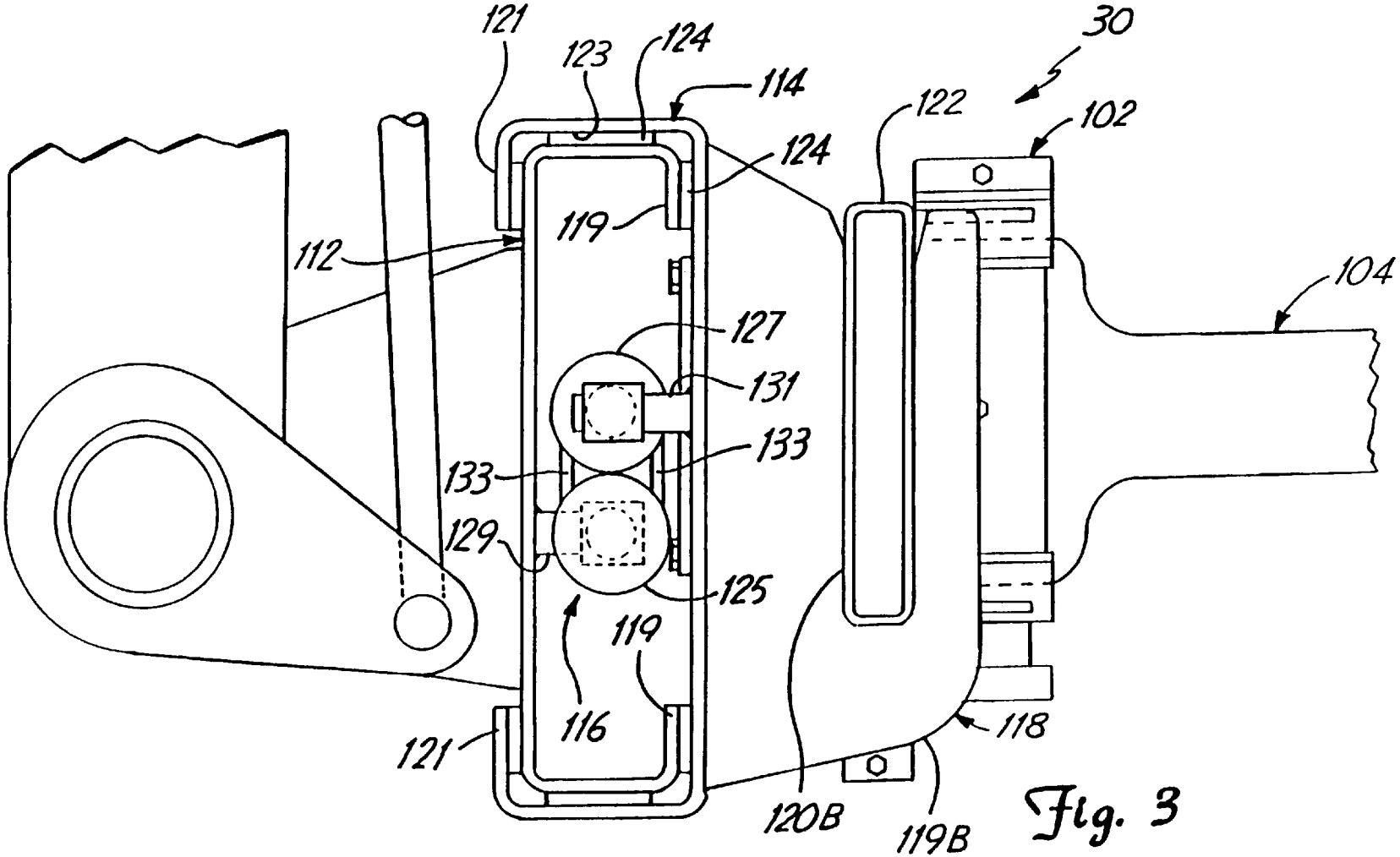
FIG. 3 is an enlarged fragmentary side elevational view of the refuse collection vehicle illustrating a carriage assembly of the receptacle collection assembly.

FIG. 3 is an enlarged fragmentary side elevational view illustrating track 112, carriage 114, linear actuator assembly 116 and flange 119*b* of pivot arm assembly support 118 of carriage assembly 100 in greater detail. As best shown by FIG. 3, track 112 is an elongate C-shaped member for being slidably received by carriage 114 and for housing linear actuator assembly 116. Track 112 includes inwardly bent ends 119 spaced from one another a sufficient distance for permitting actuator assembly 116 to be securely mounted between track 112 and carriage 114 and to move with the movement of carriage 114 between ends 119 along the length of track 112. Track 112 includes an exterior surface 123 having low static and dynamic coefficients of friction to facilitate sliding movement of carriage 114 within chamber 117 of track 112. Preferably, surface 123 is formed by riveting or otherwise fixedly coupling strips 124 of wear resistant material having low coefficients of friction, such as plastic or bronze, to track 112. Alternatively, surface 123 may be laminated, sprayed or otherwise coated on an exterior surface of track 112 for wear and reduced frictional resistance.

Carriage 114 is preferably an elongate member having a C-shaped cross-section. Carriage 114 is preferably sized so as to fit about surface 123 of track 112. Preferably, carriage 114 is sized in close tolerance with track 112 to produce steady movement of carriage 114. Carriage 114 includes inwardly bent ends 121 for maintaining carriage 114 about track 112. Ends 121 are preferably spaced apart from one another to permit actuator assembly 116 to be coupled between track 112 and carriage 114. Because carriage 114 partially encloses and engages all sides of track 112, track 112 steadily and reliably guides movement of carriage 114 to steadily move pivot assembly 104, pivot assembly 106 (shown in FIGS. 6 and 7) and receptacle engaging assembly 104.

Linear actuator assembly 116 is substantially similar to linear actuator assembly 116 disclosed in co-pending U.S. patent application Ser. No. 08/666,927, filed Jun. 20, 1996 (herein incorporated by reference) and includes linear actuator 125, linear actuator 127, pins 129, 131 and actuator coupling members 133. Linear actuator 125 preferably comprises a hydraulic cylinder assembly having an end fixedly coupled to track 112 by pin 129. Linear actuator 127 preferably comprises a hydraulic cylinder assembly positioned adjacent linear actuator 125 and having an end fixedly coupled to carriage 114 by pin 131.

Actuator coupling members 133 fixedly couple actuators 125 and 127 together. Actuator coupling members 133 preferably comprise metal blocks which secure linear actuators 125 and 127 together, preferably by welding. As a result, selective extension and retraction of actuators 125 and 127 moves carriage 114 within track 112 towards curbside 21 or towards streetside 22. In particular, because end 135 of actuator 125 is fixedly coupled to track 112 by pin 129, extension of actuator 125 moves carriage 114 towards the curbside 21 of track 112. Extension of actuator 127 moves carriage 114 further towards the curbside 21. Because actuator 125 is fixedly coupled to actuator 127 by coupling members 133 and because actuator 127 is fixedly coupled to carriage 114 by pin 131, retraction of actuator 125 moves carriage 114 towards streetside 22 of track 112. Retraction of actuator 127 further moves carriage 114 towards streetside 22. Because linear actuator assembly 116 includes two individual linear actuators fixedly coupled together and having a single end coupled to either track 112 or carriage 114, linear actuator assembly 116 is bi-directional and is capable of extending carriage 114 farther outward away from track 112 towards either the curbside 21 or the streetside 22.

As can be appreciated, carriage assembly 100 may have a variety of alternative structures and linear actuating mechanisms for moving carriage 114 along track 112. For example, carriage 114 may alternatively comprise a telescopic bar or cylinder. Furthermore, in lieu of linear actuator assembly 116, movement of carriage 114 may be implemented by a rack and pinion with a hydraulic or electric motor, a chain powered by a pair of spaced apart sprockets and coupled to the carriage, or a hydraulic cylinder in combination with a chain for moving carriage 114 relative to track 112.

As best shown by FIG. 3, flange 119*b* of pivot arm assembly support 118 is generally a U-shaped member fixedly coupled to carriage 114 forward of carriage 114. Slot 120*b* of flange 119*b* opens upwardly and is sized for receiving base 122 of pivot arm assembly 102. Flange 119*a* (shown in FIG. 2) is substantially identical to flange 119*b*. As shown by FIG. 3, slot 120*b* is preferably sized in close conformity with the shape and dimensions of base 122 so as to engage three sides of base 122 for supporting and stabilizing base 122 in a plurality of directions. Flanges 119*a* and 119*b* each receive and support base 122 to alternatively stabilize base 122 of pivot arm assembly 102 when pivot arm assembly 102 is rotated so as to engage a refuse receptacle located streetside and curbside, respectively.

B. PIVOT ARM ASSEMBLY

Figure 4:
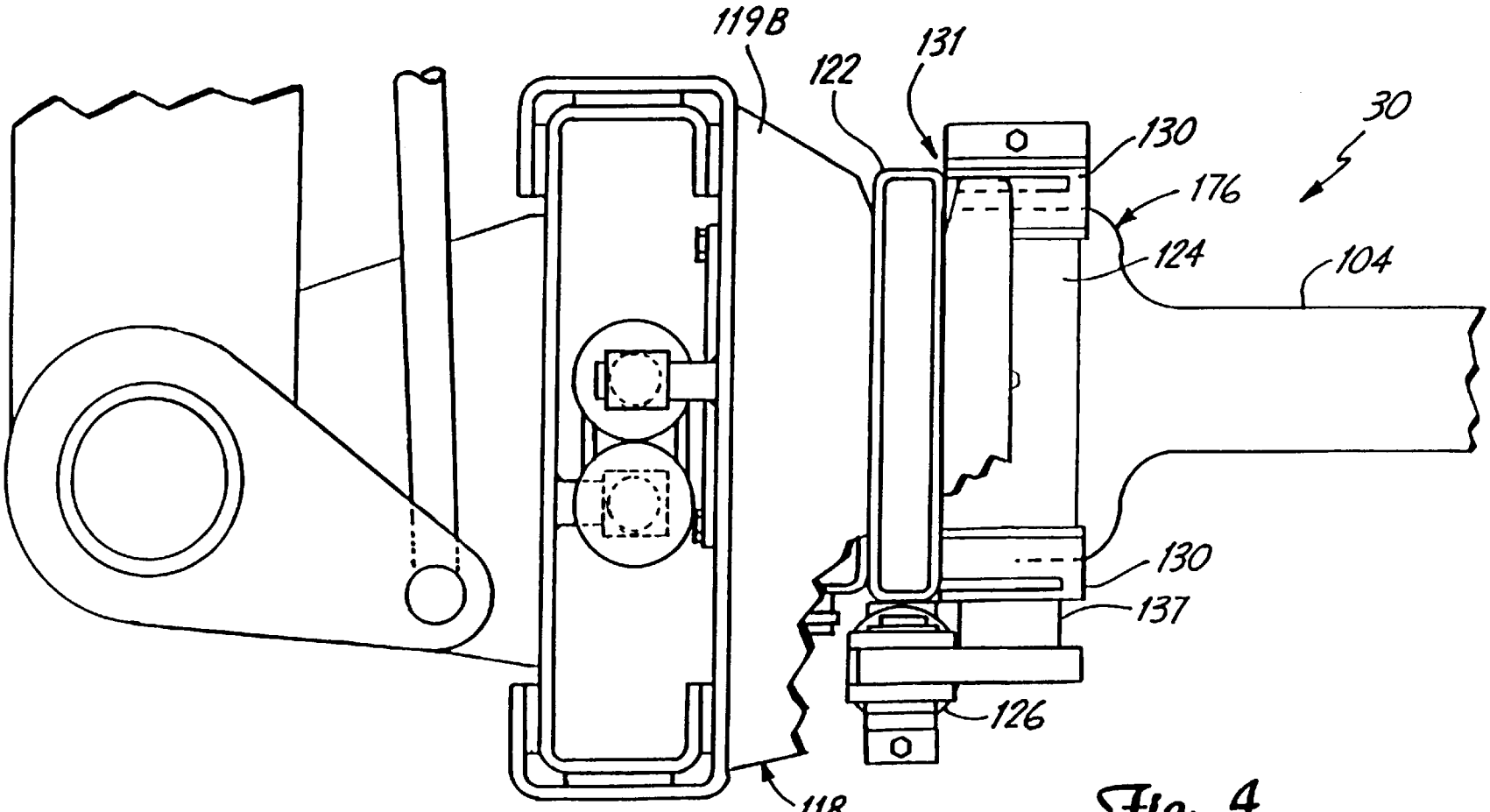
FIG. 4 is an enlarged fragmentary side elevational view of the refuse collection vehicle illustrating a pivot arm assembly of the receptacle collection assembly.
Figure 5:
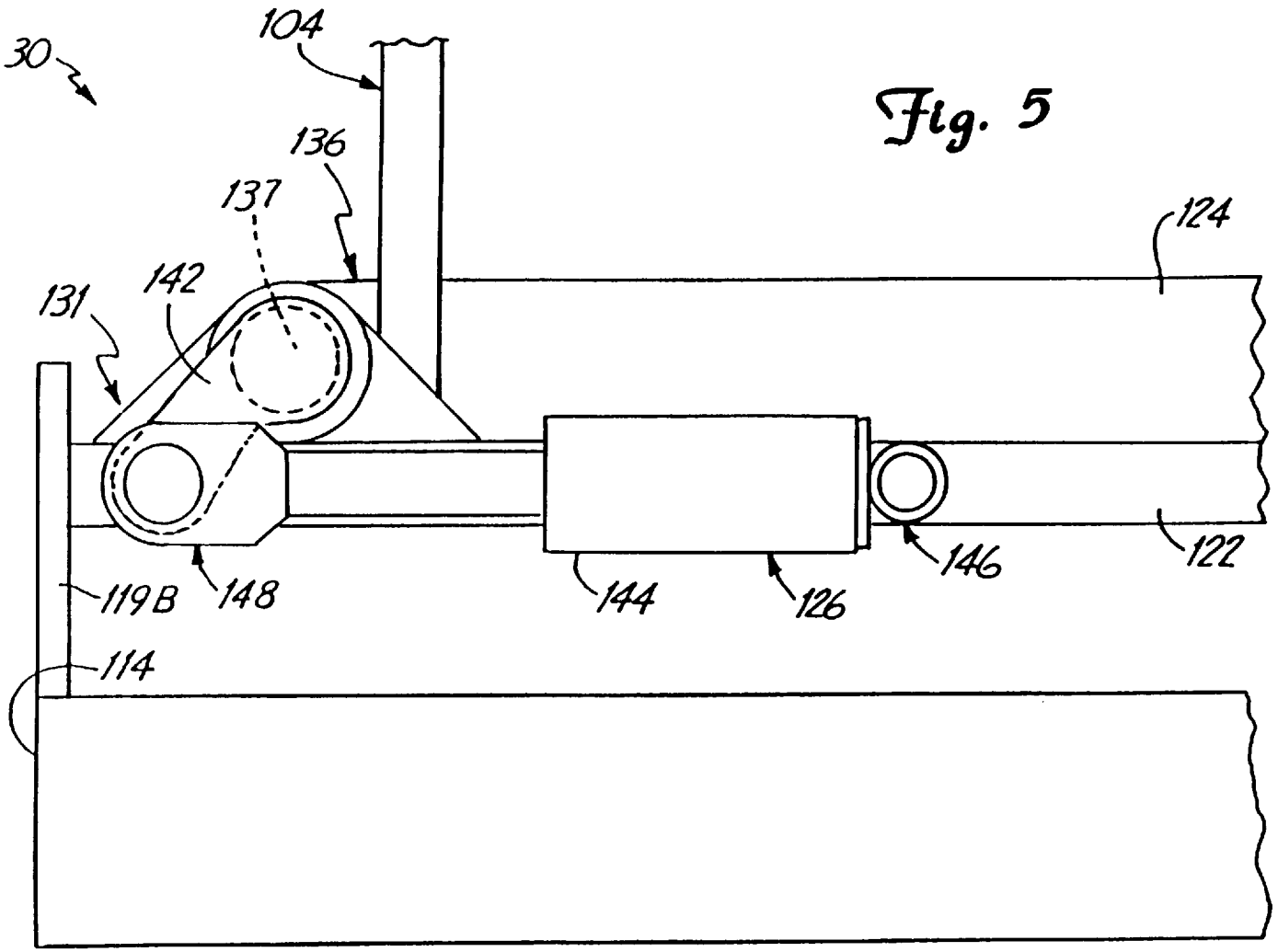
FIG. 5 is an enlarged fragmentary bottom elevational view of the pivot arm assembly.

FIGS. 4 and 5 illustrate base 122, pivot arm 124 and actuator 126 of pivot arm assembly 102 in greater detail. FIG. 4 is an enlarged fragmentary side elevational view of refuse collection assembly 30 with portions of flange 119*b* removed for illustrating pivot arm assembly 102. FIG. 5 is a fragmentary bottom elevational view of refuse collection assembly 30. As best shown by FIG. 4, base 122 of pivot arm assembly 102 includes a forwardly extending pair of ears 130 which define a pair of aligned bores. Ears 130 extend forward from base 122 proximate end 131 of base 122. Ears 130 provide a mount for pivotally receiving an end of pivot arm 124. Pivot arm 124 includes a pin 137 fixedly coupled to arm 124 and extending through ears 130 of support 122. As a result, pin 137 pivotally couples arm 124 to base 122.

As shown by FIG. 5, actuator 126 includes bell crank 142 and linear actuator 144. Bell crank 142 preferably comprises a pair of flat opposing plates having a first end fixedly coupled to pin 137 of pivot arm 124 and a second end pivotally coupled to an extendable and retractable end of linear actuator 144.

Actuator 144 selectively pivots pivot arm 124. Actuator 144 has a first end 146 fixedly coupled to base 122 and a second end 148 coupled to bell crank 142. As a result, actuation of actuator 144 moves bell crank 142 to rotate or pivot arm 124 about the axis of pin 137 so as to move arm 124 between a first position in which arm 124 is generally parallel to base 122 and a second position in which arm 124 is generally perpendicular to base 122. Actuator 144 preferably comprises a hydraulic cylinder assembly as is conventionally known. Alternatively, actuator 144 may comprise any one of a variety of linear actuators for selectively imparting linear motion such as solenoids, rack and pinion arrangements, pneumatic cylinder assemblies and the like. Moreover, in lieu of using a linear actuator in conjunction with a bell crank to rotate or pivot arm 124 about the axis of pin 137, pivot arm assembly 102 may alternatively utilize anyone of a variety of well-known rotational actuators such as hydraulic rotary actuators, rack and pinion arrangements and the like.

C. VERTICAL PIVOT ASSEMBLY

Figure 6:
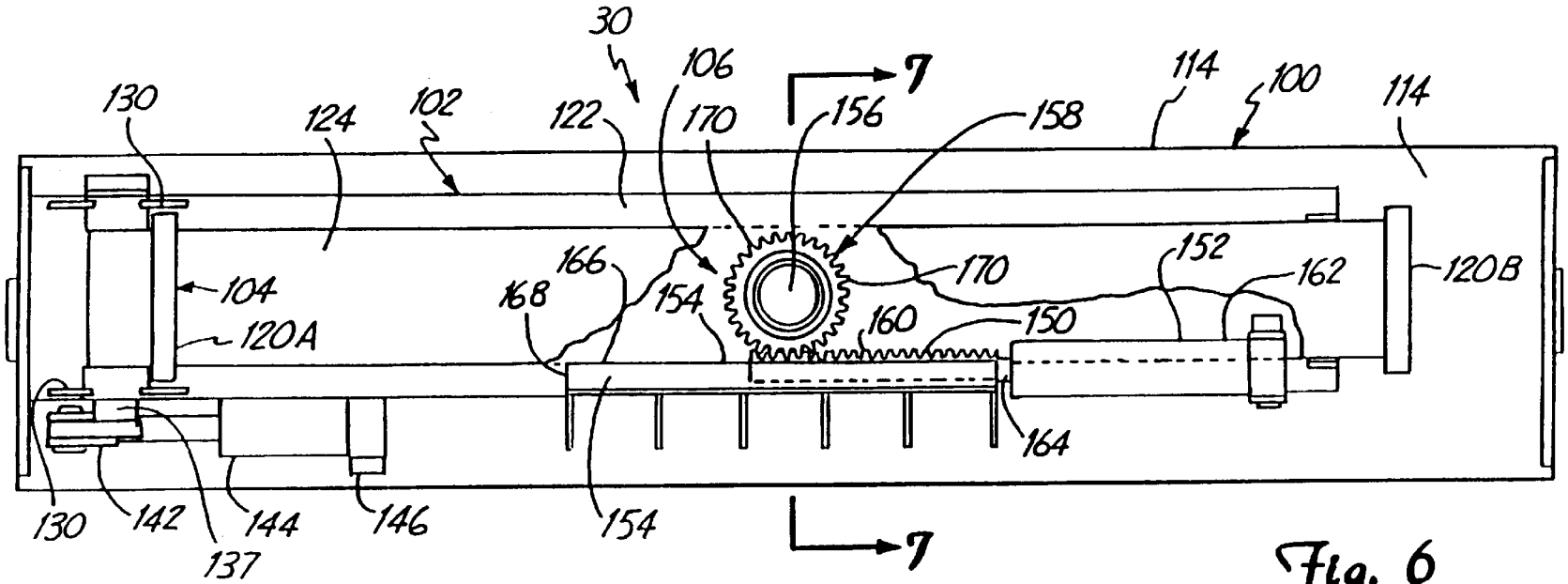
FIG. 6 is a fragmentary front elevational view of the refuse collection vehicle with portions removed for illustrating a pivot assembly of the refuse collection assembly.
Figure 7:
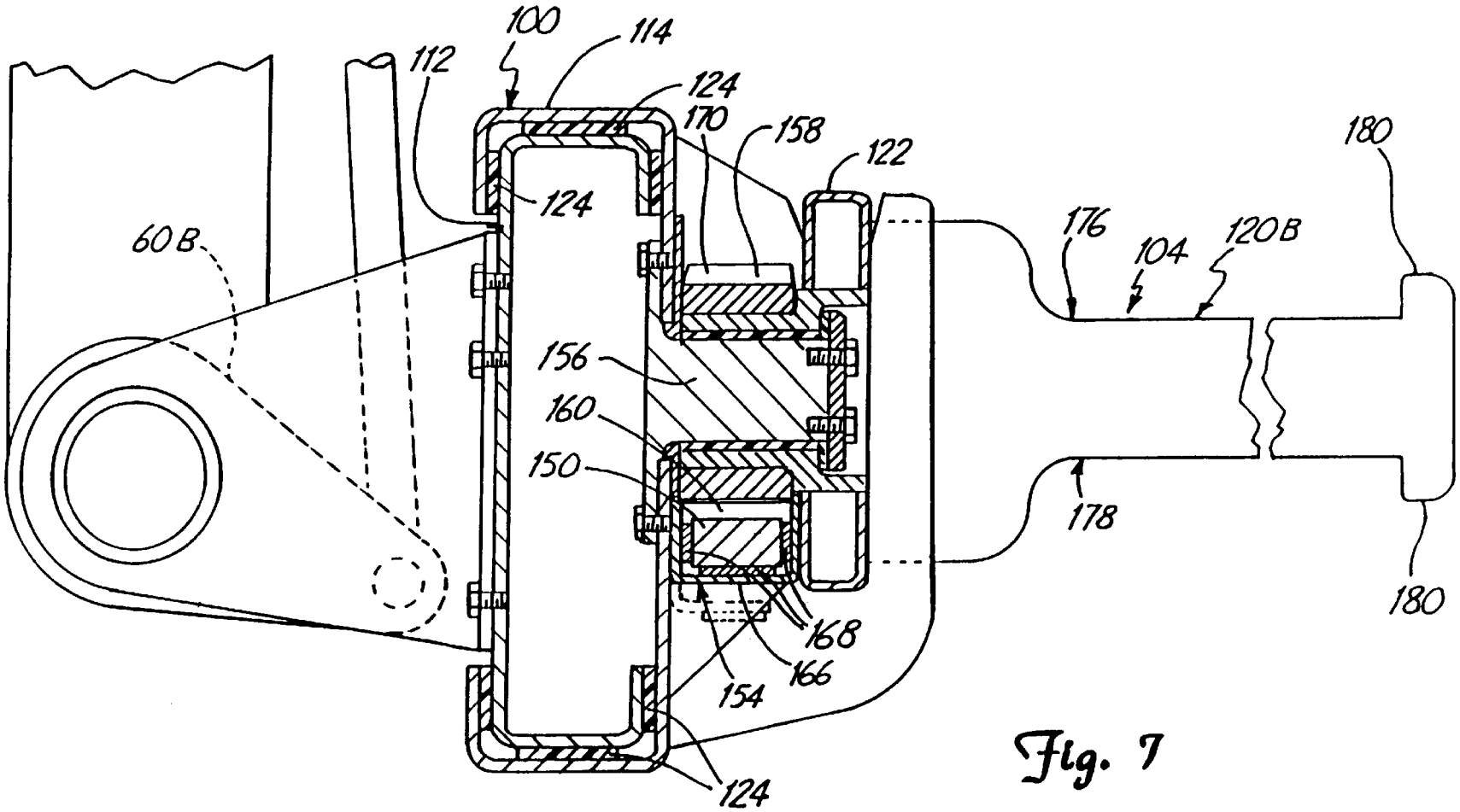
FIG. 7 is a cross-sectional view of a front portion of the refuse collection vehicle illustrating the pivot assembly of the refuse collection assembly.

FIGS. 6 and 7 illustrate pivot assembly 106 in greater detail. FIG. 6 is a fragmentary front elevational view of refuse collection assembly 30 with portions removed for illustration purposes. FIG. 7 is a cross-sectional view of pivot assembly 106 taken along lines 7—7 of FIG. 6. As best shown by FIG. 6, pivot assembly 106 pivotally couples pivot arm assembly 102 to a support such as carriage assembly 100 so that pivot arm assembly 102 may be pivoted or rotated approximately 180 degrees. Pivot assembly 106 preferably comprises a rotary actuator coupled between base 122 of pivot arm assembly 102 and carriage 114 of carriage assembly 100. Pivot assembly 106 generally includes rack gear 150, linear actuator 152, slide assembly 154, spindle 156 and spur gear 158. Rack gear 150 is an elongate rack having teeth 160 for engaging spur gear 158. Rack gear 150 is moved with respect to spur gear 158 by linear actuator 152.

Linear actuator 152 preferably comprises a hydraulic cylinder assembly having a cylinder 162 and rod 164. Cylinder 162 is fixedly coupled to a stationary member, preferably carriage 114. Rod 164 is actuable with respect to cylinder 162 and is fixedly coupled to rack gear 164. Selective actuation of linear actuator 152 linearly moves rack gear 150 relative to spur gear 158. As can be appreciated, a variety of other well-known linear actuators such as solenoids, pneumatic cylinder assemblies and other mechanical or electric mechanisms may be used to linearly reciprocate rack gear 150 relative to spur gear 158.

As best shown by FIG. 7, slide assembly 154 slides and steadies the reciprocal movement of rack gear 150 with respect to spur gear 158 and includes slide 166 and wear strips 168. Slide 166 is an elongate rigid member defining an elongate channel for receiving a portion of rack gear 150. Wear strips 168 extend along the length of slide 166 and are preferably formed from a rigid wear resistant material having a low co-efficient of friction such as a polymeric material, bronze or aluminum. Wear strips 168 contact a back side of rack gear 150 below teeth 160 to steadily guide the reciprocal movement of rack gear 150 relative to spur gear 158. As can be appreciated, wear strips 166 may be omitted and replaced with coatings or laminants of wear resistant, low friction materials applied to slide 166. As can further be appreciated, a variety of alternative support structures may be used for guiding movement of rack gear 150 with respect to spur gear 158.

Spindle 156 is fixedly coupled, preferably by bolting, to carriage 114 and extends forward of carriage 114 towards base 122 of pivot arm assembly 102. Spindle 156 provides an axis about which spur gear 158, pivot arm assembly 102 and receptacle engaging assembly 104 rotate.

Spur gear 158 comprises a conventional spur gear having teeth 170 at least partially surrounding spindle 156. Spur gear 158 is fixedly coupled to base 122 of pivot arm assembly 102 and is rotatably coupled about spindle 156 so that rotation of spur gear 158 correspondingly rotates pivot arm assembly 102 and receptacle engaging assembly 104. Pivot assembly 106 pivots or rotates pivot arm assembly 102 and receptacle engaging assembly 104 about spindle 156 to position pin 137 of pivot arm assembly 102 adjacent either curbside 21 or streetside 22 so that pivot arm 124 may pivot about pin 137 to face either curbside 21 or streetside 22, respectively. As a result, receptacle engaging assembly 104 may be selectively moved so as to face curbside 21 or streetside 22 and selectively extended towards curbside 21 or streetside 22 by carriage assembly 100 to engage refuse receptacles positioned both curbside 21 and streetside 22. Although the rotary actuator comprising pivot assembly 106 is illustrated as including a linear actuator in conjunction with a spur gear, pivot assembly 106 may alternatively be hinged to carriage assembly 100 and may include a variety of other conventional rotary actuators which are capable of pivoting or rotating pivot arm assembly 102 and receptacle engaging assembly 104 in a substantially vertical plane.

D. RECEPTACLE ENGAGING ASSEMBLY

FIG. 7 also illustrates receptacle engaging assembly 104 in greater detail. Receptacle engaging assembly 104 preferably includes a pair of opposite, spaced apart forks 120*a* (shown in FIG. 6) and 120*b*. Fork 120*b*is substantially identical to fork 120*a*. As best shown by FIG. 7, fork 120*b* is an elongate rigid bar configured for releasably engaging a refuse receptacle 250 (shown in FIG. 1) having an elongate channel or slot 252 configured for receiving fork 120*b*. The refuse receptacle 250 shown in FIG. I preferably also has a similar elongate slot positioned on an opposite side of the refuse receptacle 250 for receiving fork 120*a* (illustrated in FIG. 6). As shown by FIG. 7, fork 120*b* includes a first longitudinal surface 176 and a second longitudinal surface 178. Surfaces 176 and 178 of fork 120*a* each include a shoulder or hook 180 configured for hooking and retain refuse receptacle 250 when fork 120*a* is inserted through slot 252. As shown by FIG. 7, surfaces 176 and 178 mirror one another and are both configured for engaging a corresponding surface of refuse receptacle 250. As a result, fork 120*b*, as well as fork 120*a*, can engage refuse receptacle 250 independent of whether surface 176 or surface 178 is oriented by pivot assembly 106 so as to face upward or downward. This dual configuration of fork 120*b*, as well as fork 120*a* (shown in FIG. 2), enables receptacle collection assembly 30 to collect refuse receptacles positioned on both curbside 21 and streetside 22. As can be appreciated, receptacle engaging assembly 104 may have any one of a variety of well-known configurations depending upon the configuration of the refuse receptacle to be engaged. For example, refuse receptacle engaging assembly 104 may alternatively comprise hooks, grabber arms or various other mechanical structures which are utilized for grasping a refuse receptacle. However, in contrast to conventional receptacle engaging mechanisms, receptacle engaging assembly 104 should preferably be configured for engaging a refuse receptacle independent of the vertical orientation of the receptacle engaging assembly.

III. OPERATION OF REFUSE RECEPTACLE COLLECTION ASSEMBLY

Figure 8D:
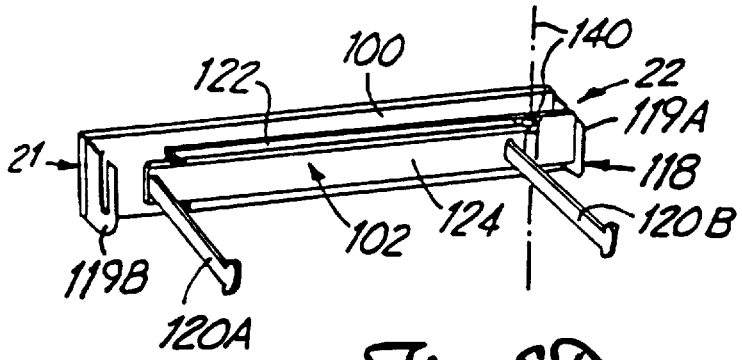

FIGS. 8A–8E are perspective views illustrating pivot arm assembly 102 and receptacle engaging assembly 104 rotated and pivoted relative to carriage assembly 100 for engaging refuse receptacles positioned curbside 21 and streetside 22. For purpose of illustration, pivot arm 124 of pivot arm assembly 102 is initially positioned parallel to base 122 and to carriage assembly 100 as shown by FIG. 8A, so that forks 120*a* and 120*b* extend generally perpendicular to carriage assembly 100 forward of refuse collection vehicle 20 (shown in FIG. 1). In this position, forks 120*a* and 120*b* of receptacle engaging assembly 104 may engage a refuse receptacle positioned forward of the refuse collection vehicle. In addition, once pivot arm 124 and forks 120*a*, 120*b* are returned to this initial position shown in FIG. 8A, a refuse receptacle engaged by refuse receptacle engaging assembly 104 may be lifted and tilted over cab 32 by arms 60*a*, 60*b* into loading chute 56 (shown in phantom in FIG. 1).

FIG. 8B illustrates pivot arm 124 pivoted in a clockwise direction as indicated by arrow 200 so as to extend substantially perpendicular to base 122 and carriage assembly 100 so that forks 120*a* and 120*b* face curbside 21 for engaging a refuse receptacle (not shown) positioned curbside 21. Once forks 120*a* and 120*b* of refuse receptacle engaging assembly 104 are aligned with a refuse receptacle positioned curbside 21, carriage assembly 100 may be selectively actuated to move carriage 114, pivot arm 124 and forks 120*a*, 120*b* of receptacle engaging assembly 104 towards curbside 21 into engagement with the refuse receptacle (not shown). After the refuse receptacle has been engaged, carriage assembly 100 may be selectively actuated to move the engaged refuse receptacle (not shown) with respect to vehicle 20. To return pivot arm 124 to the position shown in FIG. 8A, pivot arm 124 is pivoted counterclockwise as indicated by arrow 202. As a result, the engaged refuse receptacle is also moved and carried from a position curbside 21 to a position forward of carriage assembly 100 so that the refuse receptacle may be raised and unloaded into refuse collection vehicle 20 by arms 60*a*, 60*b* (shown in FIGS. 1 and 2).

To alternatively collect refuse receptacles positioned streetside 22, pivot assembly 106 (shown in FIG. 6), rotates pivot arm assembly 102 in a generally clockwise direction, as indicated by arrows 206, to reposition pivot axis 140 of pivot arm 124 adjacent streetside 22 as shown in FIG. 8D. The position of pivot arm assembly 102 shown in FIG. 8D is similar to the position of pivot arm assembly 102 shown in FIG. 8A except that pivot axis 140 is positioned streetside 22 rather than curbside 21. As with the positioning of pivot arm 124 shown in FIG. 8A, pivot arm 124 extends generally parallel to base 122 and carriage assembly 100 in the position shown in FIG. 8D. In this position, forks 120*a* and 120*b* of receptacle engaging assembly 104 extend generally perpendicular to base 122 and carriage assembly 100 forward of the refuse collection vehicle. As a result, forks 120*a* and 120*b* are positioned for engaging a refuse receptacle located forward of the refuse collection vehicle. In addition, an engaged refuse receptacle may be lifted and unloaded into loading chute 56 (shown in FIGS. 1 and 2) when the receptacle is moved to the position shown in FIG. 8D.

Figure 8E:
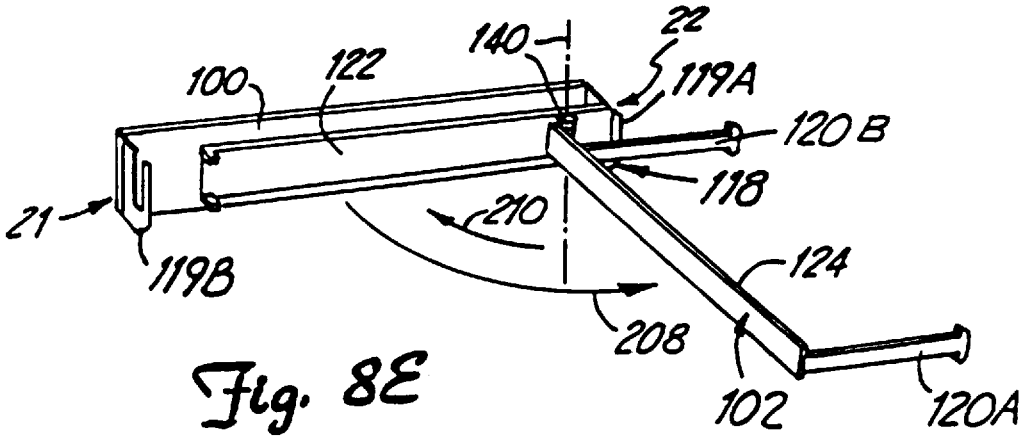

As shown in FIG. 8E, to engage a refuse receptacle positioned streetside 22, pivot arm 124 is pivoted in a generally counterclockwise direction as indicated by arrow 208 so as to be generally perpendicular to base 122 and carriage assembly 100. As a result, forks 120*a*, 120*b* face toward streetside 22 for alignment and engagement with a refuse receptacle (not shown) positioned streetside 22. Once forks 120*a* and 120*b* are properly aligned with the refuse receptacle positioned streetside, carriage assembly 100 may be actuated to move carriage 114 towards streetside 22 and to also move pivot arm 124 and forks 120*a*, 120*b* into engagement with the refuse receptacle. Once the refuse receptacle is engaged by forks 120*a* and 120*b* , carriage assembly 100 may be selectively actuated to move the engaged refuse receptacle (not shown) with respect to vehicle 20. To return pivot arm 124 and receptacle engaging assembly 104 to the position shown in FIG. 8D, pivot arm 124 is pivoted in a generally clockwise direction as indicated by arrow 210. As a result, the engaged refuse receptacle is also moved from its original streetside position to a position in front of and forward carriage assembly 100 between arms 60*a*, 60*b* (shown in FIGS. 1 and 2). Once returned to this initial position, the refuse receptacle may be lifted and unloaded into loading chute 56 by arms 60*a*, 60*b* (shown in phantom in FIG. 1). Because forks 120*a* and 120*b* of receptacle engaging assembly 104 have mirroring upper and lower surfaces configured for engaging the refuse receptacle, forks 120*a* and 120*b* can engage a refuse receptacle when positioned as shown in FIGS. 8A and 8B or when positioned as shown in FIGS. 8D and 8E.

IV. ALTERNATE EMBODIMENT OF REFUSE RECEPTACLE COLLECTION ASSEMBLY

Figure 9:
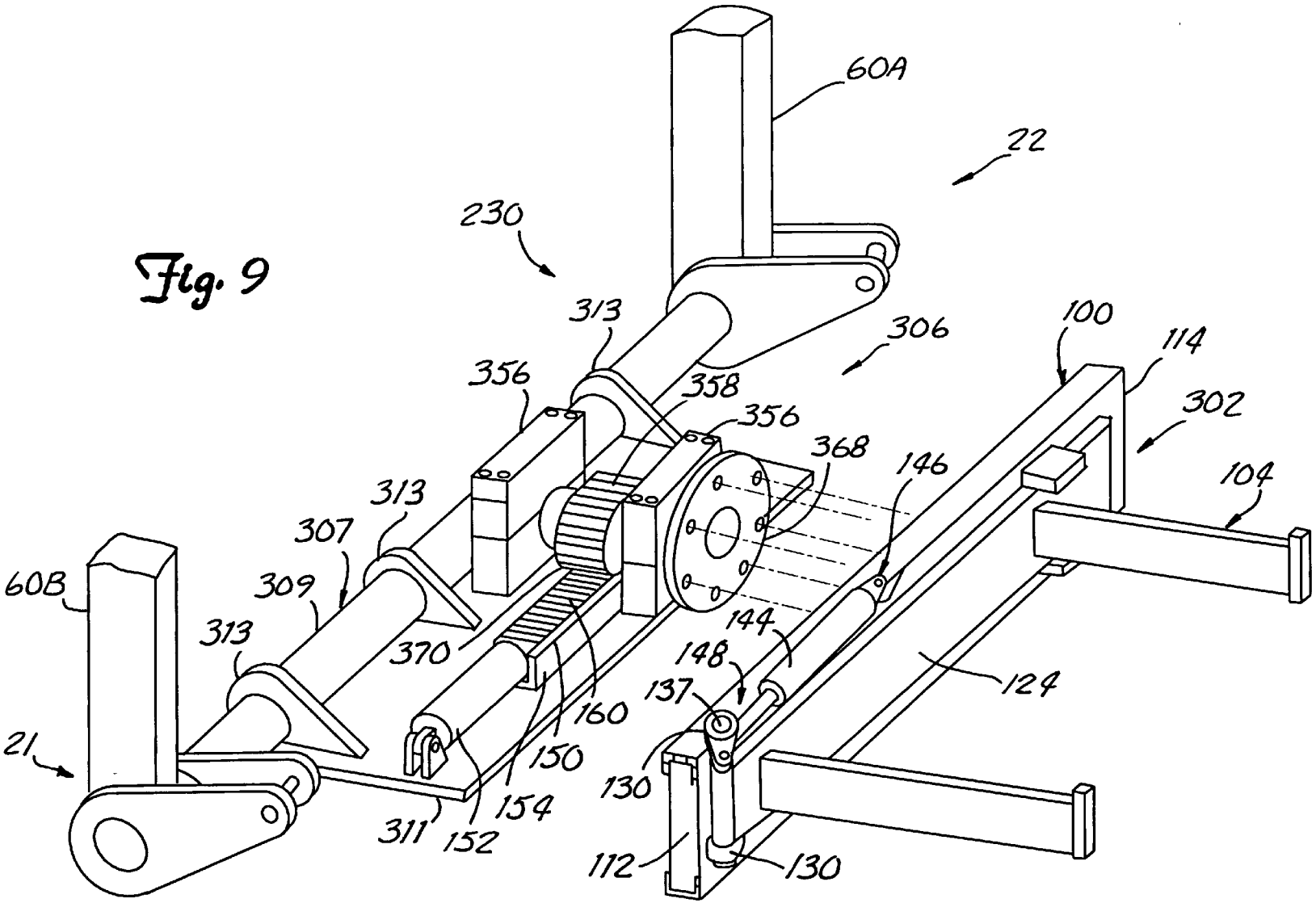
FIG. 9 is a partially exploded perspective view of an alternate embodiment of the refuse receptacle collection assembly.

FIG. 9 is a partially exploded perspective view of receptacle collection assembly 230, an alternate embodiment of receptacle collection assembly 30 shown in FIGS. 1–8. For purposes of illustration, those elements of receptacle collection assembly 230 which are the same as corresponding elements of receptacle collection assembly 30 are similarly numbered. Refuse receptacle collection assembly 230 is similar to refuse receptacle collection assembly 30 except that receptacle collection assembly 230 includes pivot assembly 306 and pivot arm assembly 302 in lieu of pivot assembly 106 and pivot arm assembly 102. As shown by FIG. 9, receptacle collection assembly 230 is similar to receptacle collection assembly 30 except that pivot assembly 306 is coupled between carriage assembly 100 and arms 60*a*, 60*b* in contrast to pivot assembly 106 which is coupled between carriage assembly 100 and pivot arm assembly 102 (as shown in FIG. 2). As a result, receptacle collection assembly 230 has increased stability when engaging and lifting heavier loads.

Pivot assembly 306 pivotally supports carriage assembly 100 and pivot arm assembly 302. Pivot assembly 306 generally includes mounting assembly 307, rack gear 150, linear actuator 152, slide assembly 154, bearing units 356 and spur gear 358. Mounting assembly 307 supports pivot assembly 306 and includes bar 309, platform 311 and gussets 313. Bar 309 is fixedly coupled between arms 60*a* and 60*b*. Platform 311 is rigidly supported in place adjacent bar 309 by gussets 313 which are preferably welded to both bar 309 and platform 311. Platform 311 is coupled to and supports rack gear 150, linear actuator 152, slide assembly 154 and bearing units 356. Rack gear 150, linear actuator 152 and slide assembly 154 are substantially identical to similarly numbered elements in refuse receptacle collection assembly 30.

Bearing units 356 are fixedly coupled to platform 311, preferably by welding, and rotatably support spur gear 358. Bearing units 356 preferably comprise conventionally known pillow boxes including bearing balls for rotatably supporting spur gear 358. Spur gear 358 is rotatably supported by bearing unit 356 and includes mounting portion 368 and teeth 370. Mounting portion 368 is fixedly coupled, preferably by bolting, to track 112 of carriage assembly 100. Teeth 370 are similar to teeth 170 and are configured for engaging corresponding teeth 160 of rack gear 150. As a result, extension and retraction of rack gear 150 by linear actuator 152 rotates spur gear 358 to correspondingly rotate track 112 of carriage assembly 100. Rack gear 150 and linear actuator 152 sufficiently extend and retract to rotate track 112 at least approximately 180° so that pivot arm assembly 302 may be pivoted towards both curbside 21 and streetside 22.

Pivot arm assembly 302 is substantially identical to pivot arm assembly 102 except that pivot arm assembly 302 omits base 122 (shown in FIG. 2) and utilizes carriage 114 for pivotally supporting pivot arm 124. As a result, ears 130 pivotally couple pivot arm 124 to carriage 114. Actuator 144 has a first end 146 fixedly coupled to carriage 114 and a second end 148 coupled to a bell crank (not shown) to rotate or pivot pivot arm 124 about an axis of pin 137 to move arm 124 between a first position in which arm 124 is generally parallel to carriage 114 and a second position in which arm 124 is generally perpendicular to carriage 114. Similar to receptacle collection assembly 30, receptacle collection assembly 230 may engage refuse receptacles located in front of the refuse collection vehicle, streetside with respect to the collection vehicle or curbside with respect to the collection vehicle.

V. CONCLUSION

Refuse receptacle collection assemblies 30 and 230 enable an operator to quickly and efficiently collect and unload refuse contained in refuse receptacles positioned in front of the refuse collection vehicle, curbside with respect to the refuse collection vehicle or streetside with respect to the refuse collection vehicle without unboarding the refuse collection vehicle or physically lifting and moving the refuse receptacle. In addition, refuse receptacle collection assemblies 30 and 230 enables the operator to collect refuse receptacles positioned on both sides of a street in a single pass down the street. If the street is narrow, the operator merely drives the vehicle down the street a single time and pivots pivot arm assembly 102, 302 and receptacle engaging assembly 104, as necessary, to collect refuse receptacles located both streetside and curbside. Alternatively, if the street is wide, the driver merely needs to drive the refuse collection vehicle in an S-shaped pattern down the street to collect refuse receptacles positioned on both sides of the street. As a result, refuse receptacles positioned on both sides of a one-way street may be easily collected. In addition, refuse receptacles on both sides of the street may be collected without turning the refuse collection vehicle around to save time and expense.

As can be appreciated, refuse receptacle collection assemblies 30, 230 may be used with a variety of different refuse collection vehicles. For example, refuse collection assemblies 30, 230 may be used with the refuse collection vehicle having a storage body with at least one refuse compartment and a dumping assembly for emptying a refuse receptacle into the storage body before moving to the next collection site, such as the refuse collection vehicle 20 illustrated. Alternatively, refuse receptacle collection assemblies 30, 230 may be used with a refuse collection vehicle in which a refuse receptacle is engaged and directly transported to a disposal site for emptying.

Moreover, refuse receptacle collection assemblies 30, 230 may have a variety of different configurations while still engaging and collecting refuse receptacles positioned both streetside and curbside. For example, refuse receptacle collection assemblies 30, 230 may alternatively include a rigid fixed support mounted between arms 60*a* and 60*b* in lieu of the movable support provided by carriage assembly 100. In such an alternate embodiment, pivot assembly 106, 306 would pivotally couple pivot arm assembly 102, 302 to the support and would rotate pivot arm assembly in a substantially vertical plane so that pivot arm 124 and receptacle engaging assembly 104 may engage receptacles positioned both curbside and streetside. In lieu of pivot arm assembly 102, 302, refuse receptacle collection assemblies 30, 230 may simply include a forwardly projecting arm extending from carriage 114, wherein the arm pivotally supports a curbside receptacle engaging assembly. Rotation of the receptacle engaging assembly in a substantially vertical plane approximately 180 degrees pivots the receptacle engaging assembly from its initial curbside facing position to a streetside facing position. Once facing streetside, the receptacle engaging assembly may be moved towards the streetside by movement of carriage 114 along track 112 into engagement with a streetside container. Upon engagement with the streetside container, the receptacle engaging assembly may be retracted to a position in front of the refuse collection vehicle by movement of carriage 114 along track 112. Once the engaged refuse receptacle is positioned generally forward of the refuse collection vehicle in longitudinal alignment with the loading chute of the refuse collection vehicle, the dumping assembly may lift and tilt the engaged refuse receptacle so as to unload the refuse receptacle into the loading chute. A similar process can be used to engage an unload refuse receptacles located curbside.

Furthermore, receptacle collection assemblies 30, 230 may alternatively include a pivot arm pivotally coupled to carriage 114 of carriage assembly 100 intermediate ends of carriage 114 so as to pivot approximately 180 degrees or greater in a generally horizontal plane so as to extend the pivot arm to both curbside and streetside. In such an alternate embodiment, the receptacle engaging assembly 104 would be supported at an end of the pivot arm such that the pivot arm and the receptacle engaging assembly have a generally T or L-shaped configuration. As with the preferred embodiment of refuse collection 30 illustrated, such an alternate embodiment could engage refuse receptacles located both streetside and curbside and could position the receptacles in front of the refuse collection vehicle for direct unloading into the storage body of the refuse collection vehicle.

Although the present invention has been described with reference to preferred embodiments, workers skilled in the art will recognize that changes may be made in form and detail without departing from the spirit and scope of the invention.

What is claimed is:

1. A refuse receptacle collection assembly comprising:

a receptacle engaging assembly configured for engaging a refuse receptacle to move the refuse receptacle; and repositioning means coupled to the receptacle engaging assembly for selectively repositioning the engaging assembly so that the engaging assembly may be moved between a first position in which the engaging assembly faces a first direction for engaging receptacles located on a first side of the assembly and a second position in which the engaging assembly faces a second opposite direction for engaging receptacles located on a second opposite side of the assembly, and wherein the repositioning means rotates the receptacle engaging assembly approximately 180 degrees in a substantially vertical plane.

2. The receptacle collection assembly of claim 1 wherein the engagement assembly includes a receptacle engagement member having an upper surface and a second opposite lower surface, wherein the upper surface and the lower surface mirror one another and are both configured for engaging a corresponding receptacle surface of the refuse receptacle.

3. The receptacle collection assembly of claim 1 further including:

front repositioning means coupled to the receptacle engaging assembly for selectively repositioning the engaging assembly in a third position in which the engagement assembly faces forward for engaging receptacles located between the first side and the second side of the assembly.

4. The receptacle collection assembly of claim 1 wherein the receptacle engaging assembly includes a pair of spaced engagement members for engaging opposite sides of the refuse receptacle.

5. The receptacle collection assembly of claim 4 wherein the pair of spaced engagement members comprises a pair of arms fixedly spaced from one another.

6. A refuse receptacle collection assembly comprising:

a receptacle engaging assembly configured for engaging a refuse receptacle to move the refuse receptacle; and repositioning means coupled to the receptacle engaging assembly for selectively repositioning the engaging assembly so that the engaging assembly may be moved between a first position in which the engaging assembly faces a first direction for engaging receptacles located on a first side of the assembly and a second position in which the engaging assembly faces a second opposite direction for engaging receptacles located on a second opposite side of the assembly, and wherein the repositioning means includes:

a support; and a pivot arm assembly including:

base pivotally coupled to the support so as to pivot in a substantially vertical plane; and a pivot arm pivotally coupled to the base so as to pivot in a substantially horizontal plane, wherein the pivot arm supports the receptacle engaging assembly.

7. The receptacle collection assembly of claim 6 including:

an actuator for pivoting the base in the substantially vertical plane.

8. The receptacle collection assembly of claim 6, including:

an actuator for pivoting the pivot arm in the substantially horizontal plane with respect to the base.

9. The receptacle collection assembly of claim 6 wherein the support includes:

a track; and a carriage movable along the track, wherein the carriage supports the pivot arm assembly.

10. The receptacle collection assembly of claim 9 wherein the track extends from the first side to the second side and wherein the carriage is movable between a first location proximate the first side and a second location proximate the second side.

11. The receptacle collection assembly of claim 6, wherein the base is pivotally coupled to the support so as to pivot approximately 180 degrees in a substantially vertical plane.

12. The receptacle collection assembly of claim 6, wherein the pivot arm is pivotally coupled to the base so as to pivot approximately 90 degrees in a substantially horizontal plane.

13. A refuse receptacle collection assembly comprising:

a receptacle engaging assembly configured for engaging a refuse receptacle to move the refuse receptacle; and repositioning means coupled to the receptacle engaging assembly for selectively repositioning the engaging assembly so that the engaging assembly may be moved between a first position in which the engaging assembly faces a first direction for engaging receptacles located on a first side of the assembly and a second position in which the engaging assembly faces a second opposite direction for engaging receptacles located on a second opposite side of the assembly, and wherein the repositioning means includes:

a support;

a track pivotally coupled to the support so as to pivot in a substantially vertical plane;

a carriage movable along the track; and a pivot arm pivotally coupled to the track so as to pivot in substantially horizontal plane, wherein the pivot arm supports the receptacle engaging assembly.

14. The receptacle collection assembly of claim 13, wherein the track is pivotally coupled to the support so as to pivot approximately 180 degrees in a substantially vertical plane.

15. The receptacle collection assembly of claim 13, wherein the pivot arm is pivotally coupled to the track so as to pivot approximately 90 degrees in a substantially horizontal plane.

16. The receptacle collection assembly of claim 13, including:

an actuator for pivoting the pivot arm in the substantially horizontal plane with respect to the track.

17. The receptacle collection assembly of claim 13, including:

an actuator for pivoting the track in a substantially vertical plane.

18. The receptacle collection assembly of claim 13, wherein the pivot arm is pivotally coupled to the carriage.

* * * * *